United States Patent [19]

Vardi et al.

[11] Patent Number: 4,902,437

[45] Date of Patent: Feb. 20, 1990

[54] ENGINE LUBRICATING OIL COMPRISING A QUATERNARY AMMONIUM HYDROXIDE

[75] Inventors: Joseph Vardi, Demarest; Nicholas Feldman, Woodbridge; Jacob J. Habeeb; Morton Beltzer, both of Westfield, all of N.J.

[73] Assignee: Exxon Research and Engineering Company, Florham Park, N.J.

[21] Appl. No.: 290,401

[22] Filed: Dec. 29, 1988

Related U.S. Application Data

[63] Continuation-in-part of Ser. No. 130,524, Dec. 9, 1987, abandoned.

[51] Int. Cl.[4] ..... C10M 133/04

[52] U.S. Cl. ..... 252/34; 252/47.5; 252/51.5 R

[58] Field of Search ..... 252/34, 51.5 R

[56] References Cited

U.S. PATENT DOCUMENTS

| | | | |
|---|---|---|---|
| 2,911,368 | 11/1959 | Fowler et al. | 252/34 |
| 3,468,640 | 9/1969 | Barusch et al. | 44/66 |
| 3,962,104 | 6/1976 | Swietlik et al. | 252/33 |
| 4,056,531 | 11/1977 | Malec | 252/34 |
| 4,600,518 | 7/1986 | Ries et al. | 252/34 |

*Primary Examiner*—William R. Dixon, Jr.
*Assistant Examiner*—Jerry D. Johnson
*Attorney, Agent, or Firm*—John W. Ditsler

[57] ABSTRACT

The presence of a minor amount of certain quaternary ammonium hydroxides in an engine lubricating oil has been found to be effective in reducing and controlling combustion chamber deposits and octane requirement increase in spark ignition internal combustion engines and in reducing oil consumption in diesel engines.

42 Claims, 2 Drawing Sheets

ENGINE LUBRICATING OIL COMPRISING A QUATERNARY AMMONIUM HYDROXIDE

CROSS REFERENCE TO RELATED APPLICATIONS

This application is a continuation-in-part of U.S. application Ser. No. 130,524, filed Dec. 9, 1987 now abandoned.

BACKGROUND OF THE INVENTION

1. Field of the Invention

This invention relates to an improved engine lubricating oil composition and a method for improving the operation of spark ignition internal combustion engines and diesel engines. More specifically, the invention concerns adding certain quaternary ammonium hydroxides to a lubricating oil to reduce combustion chamber deposits and the octane requirement increase in spark ignition internal combustion engines, and to improve oil consumption in diesel engines.

2. Description of Related Art

The octane requirement for a new or cleaned spark fired internal combustion engine is lower than that required for an engine that has been operated for several thousand miles. This is due to deposits accumulating in the combustion chamber of the engine such that an octane requirement increase (ORI) results; i.e., the octane number of the fuel required for knock-free operation of the engine increases with time until a stable level is reached. Consequently, various compounds have been added to the fuel to prevent or reduce the formation of deposits in the combustion chamber or to remove deposits already formed in the combustion chamber (See for example U.S. Pat. No. 4,357,148 and the patents cited therein, the disclosure of which are incorporated herein by reference). However, some additives may not survive combustion of the fuel to reach the deposits that cause ORI and, thus, will not be effective in reducing ORI.

In addition to the additives described in U.S. Pat. No. 4,357,148 and the patents cited therein, certain quaternary ammonium hydroxides have been added to gasoline to reduce carburetor deposits. For example, in U.S. Pat. No. 3,468,640, a particular class of quaternary ammonium hydroxides are added to gasoline to reduce deposits in the intake system caused by introduction of blowby and puffback gases. The class of hydroxides used is characterized in that one of four alkyl groups attached to the nitrogen atom is a methyl group and the length of the carbon chain in at least one of the other alkyl groups is from 10 to 24 carbon atoms. A specific quaternary ammonium hydroxide (choline) has also been added to fuels and lubricants to neutralize naphthenic acids as well as reduce the color and corrosiveness problems caused by said acids (see U.S. Pat. No. 4,600,518). However, due to the relatively few carbon atoms in choline, it is doubtful that choline would appreciably dissolve in the lubricating oil basestock or would survive the high temperature environment of the lubricant in an automotive engine. More recently, quaternary ammonium hydroxides have been added to gasoline to reduce ORI (See U.S. Pat. No. 4,787,916).

Diesel engine manufacturers have also been concerned about reducing the buildup of crownland and piston ring deposits in these engines because of the interrelationship between these deposits and increased oil consumption. Therefore, controlling deposit formation is important in reducing oil consumption in today's high performance diesel engines. Also, control of combustion chamber deposits is important in spark ignition internal combustion engines to obtain improved engine operation.

However, none of the above-mentioned references teach or suggest adding the specific quaternary ammonium hydroxides described herein to a lubricating oil to reduce ORI and combustion chamber deposits in spark ignition internal combustion engines and to reduce oil consumption in diesel engines.

SUMMARY OF THE INVENTION

Now according to the present invention, it has been surprisingly found that the octane requirement increase for spark ignition internal combustion engines is decreased or reversed when minor amounts of quaternary ammonium hydroxides are added to the lubricating oil used in said engines. In addition, using a lubricating oil containing these hydroxides improves the cleanliness of spark ignition internal combustion engines because the tendency to form combustion chamber deposits is reduced. Furthermore, adding quaternary ammonium hydroxides to a diesel engine lubricating oil reduces the oil consumption of the engine.

DETAILED DESCRIPTION OF THE INVENTION

Figure 1:
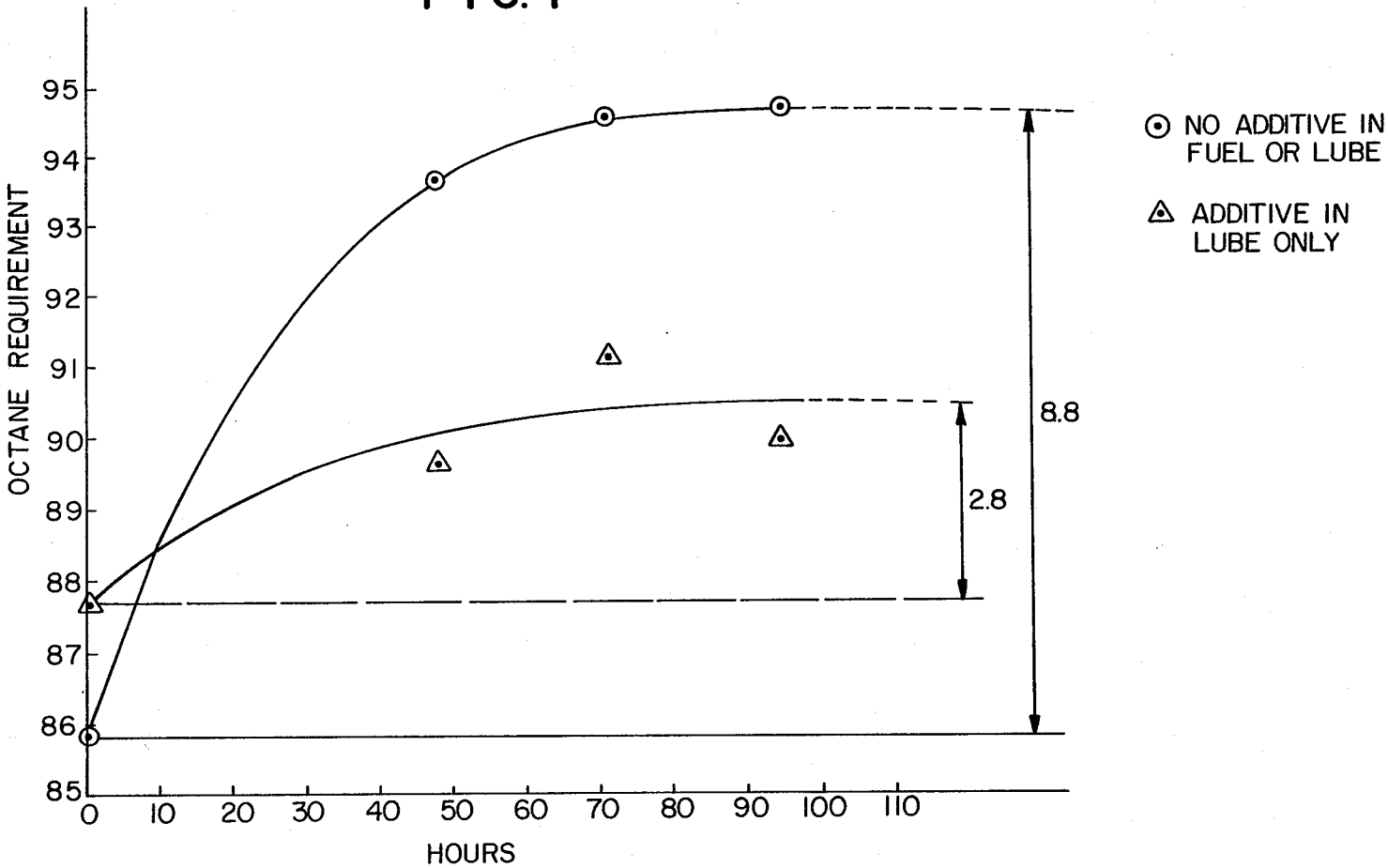
FIG. 1 is a graph showing that ORI is reduced when certain quaternary ammonium hydroxides are added to a lubricating oil used in a spark ignition internal combustion engine.

The quaternary ammonium hydroxides useful in this invention are selected from compounds having a general formula:

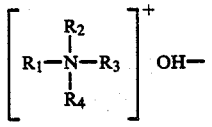

wherein $R_1$ is a hydrocarbon radical (or group) or a hydroxy terminated radical (or group) having from 1 to 24 carbon atoms, $R_2$ is a hydrocarbon radical having from 1 to 24 (preferably from 4 to 24) carbon atoms, and $R_3$ and $R_4$ are hydrocarbon radicals having from 4 to 24 carbon atoms. The hydrocarbon radicals ($R_1$, $R_2$, $R_3$, and $R_4$) can be alkyl groups, unsaturated paraffin groups, cyclic hydrocarbon groups, aryl groups, arylalkyl groups or mixtures thereof. In addition, said groups can be normal, branched, substituted groups or mixtures thereof. The hydrocarbon radicals may also contain other atoms such as nitroqen, oxygen, or sulfur; e.g., in the form of an alcohol, an amine, a ketone, a sulfide, a thiosulfide, and other functionalities.

Quaternary ammonium hydroxides in which the hydrocarbon radical is octyl, dodecyl, decyl, octadecyl, capryl radicals, or their mixtures are preferred. Preferred quaternary ammonium hydroxides are dimethyl dioctadecyl ammonium hydroxide, tetraoctyl ammonium hydroxide, tricaprylmethyl ammonium hydroxide, or mixtures thereof. Tetraoctyl ammonium hydroxide, tricaprylmethyl ammonium hydroxide, or mixtures thereof are especially preferred, with tricaprylmethyl ammonium hydroxide being most preferred.

The engine lubricating oil used herein comprises a major amount of a lubricating base oil and a minor amount of the quaternary ammonium hydroxide. The base oil may include liquid hydrocarbons such as the mineral lubricating oils, synthetic lubricating oils and mixtures thereof. The mineral oils may include paraffinic, naphthenic as well as aromatic components. The synthetic oils may include diester oils such as di(2-ethylhexyl) sebacate, azelate and adipate; complex ester oils such as those formed from dicarboxylic acids, glycols and either monobasic acids or monohydric alcohols; polyolester oils such as esters of pentaerythritol and/or trimethylol propane; and other synthetic oils known to the art.

Thus, in one embodiment, this invention is an engine lubricating oil composition comprising a major portion of a lubricating base oil which contains a minor amount of the quaternary ammonium hydroxide described above. The precise amount of quaternary ammonium hydroxide used is not critical and need only be an amount sufficient to cause a reduction in ORI or to improve combustion chamber deposit control in spark ignition internal combustion engines, or to cause a reduction in oil consumption of diesel engines. Typically, effective reductions will be obtained by using from about 0.1 to about 5 wt. %, preferably from about 0.2 to about 2.0 wt. %, quaternary ammonium hydroxide in the engine oil. The hydroxide can be added to the base oil or to a fully formulated (or finished) engine oil which contains other additives.

In another embodiment, this invention is a method for controlling the ORI of spark ignition internal combustion engines by operating such engines using a lubricating oil containing certain quaternary ammonium hydroxides in amounts sufficient to control the ORI.

In yet another embodiment, this invention is a method for reducing the formation of combustion chamber deposits e.g., piston and cylinder head deposits) in spark ignition internal combustion engines by using a lubricating oil containing certain quaternary ammonium hydroxides in amounts sufficient to reduce such deposits. Reducing combustion chamber deposits may (or may not) reduce ORI depending on whether the cylinder or cylinders containing the ORI causing deposits are sufficiently contacted with the quaternary ammonium hydroxide.

In still another embodiment, this invention is a method for reducing oil consumption in diesel engines by using a lubricating oil containing certain quaternary ammonium hydroxides in amounts sufficient to cause a reduction in oil consumption. The lubricating oil may be used in diesel engines having a wide variety of applications including automobile, bus, marine, railroad, truck, and stationary applications (e.g. electric power generation facilities).

The quaternary ammonium hydroxides described hereinabove can be readily prepared from their corresponding commercially available quaternary ammonium salt, such as a halide. For example, a quaternary ammonium chloride may be contacted with an anion exchange resin such that the chloride is exchanged to produce the corresponding quaternary ammonium hydroxide.

In addition to the quaternary ammonium hydroxides, other additives known in the art may be added to the oil composition of the present invention to form a fully formulated engine oil. Such additives include dispersants, antiwear agents, antioxidants, corrosion inhibitors, detergents, pour point depressants, extreme pressure additives, viscosity index improvers, etc. These additives are typically disclosed, for example, in "Lubricant Additives" by C. V. Smalheer and R. Kennedy Smith, 1967, pp. 1–11 and in U.S. Pat. No. 4,105,571, the disclosures of which are incorporated herein by reference.

The present invention may be further understood by reference to the following examples which are not intended to restrict the scope of the claims appended hereto.

EXAMPLE 1

Using Quaternary Ammonium Hydroxides in a Lubricating Oil Reduces ORI in Spark Ignition Internal Combustion Engines Two tests were performed using a 250 cubic inch displacement straight 6 cylinder engine. Prior to each test, the engine was cleaned by removing deposits from the intake manifolds, intake ports and combustion chamber. Both tests were performed using the same fuel and finished engine oil except that in Test 1, no quaternary ammonium hydroxides were included in the fuel or in the engine oil. In Test 2, however, the engine oil contained 0.4 wt. % tetra octyl ammonium hydroxide. The research octane requirement of the engine was determined using a standardized control procedure while increasing engine speed from 1500 to 3000 rpm in a 15 sec. period. The results are set forth in Table 1 below and shown graphically in the FIG. 1.

TABLE 1

| | Octane Requirement, Hrs on Test | | | | |
|---|---|---|---|---|---|
| | 0 | 48 | 72 | 96 | ORI |
| Test 1 | 85.8 | 93.6 | 94.5 | 94.6 | 8.8 |
| Test 2 | 87.7 | 89.5 | 91.0 | 89.6 | 2.2–3.3 |

The data in Table 1 show that at least a 60% reduction in ORI results when a quaternary ammonium hydroxide is added only to the lubricating oil of a spark ignition internal combustion engine.

EXAMPLE 2

Using Quaternary Ammonium Hydroxides in a Lubricating Oil Reduces Deposits in Spark Ignition Internal Combustion Engines Using the engine and test procedure of Example 1, three tests were performed using a 92.5 octane unleaded gasoline and a fully formulated SF/CD SAE 1OW30 engine oil except that in Test 1, no quaternary ammonium hydroxides were included in the fuel or oil. However, in Test 2, the oil contained 0.4 wt. % tricaprylmethyl ammonium hydroxide (TCMAH). In Test 3, the oil contained 0.25 wt. % TCMAH and the fuel had 0.005 wt. %. Weight of deposits on the top of all pistons and inside all cylinders were determined after 96 hours. The results are shown in Table 2 below.

TABLE 2

| | TCMAH, wt. % | | Deposits After 96 Hours, g | | |
|---|---|---|---|---|---|
| | Lube | Fuel | Piston Tops | Cylinder Heads | ORI |
| Test 1 | 0 | 0 | 11.9 | 11.3 | 7.2 |

TABLE 2-continued

| | TCMAH, wt. % | | Deposits After 96 Hours, g | | |
|---|---|---|---|---|---|
| | Lube | Fuel | Piston Tops | Cylinder Heads | ORI |
| Test 2 | 0.4 | 0 | 9.4 | 10.5 | 5.0 |
| Test 3 | 0.25 | 0.005 | 8.6 | 9.4 | 3.8 |

The data in Tests 1 and 2 show that the addition of a quaternary ammonium hydroxide to the lubricating oil used in a spark ignition internal combustion engine reduced the formation of combustion chamber deposits because the piston tops and cylinder heads were 21% and 7% cleaner, respectively.

The data in Tests 1 and 3 show that improved combustion chamber cleanliness was more pronounced when the quaternary ammonium hydroxide was present in the lubricating oil and the fuel because the piston top and cylinder head were 28% and 17% cleaner, respectively. Thus, a quaternary ammonium hydroxide may be (but need not be) added to the fuel to obtain improved engine cleanliness.

The data in Tests 1, 2, and 3 confirm that quaternary ammonium hydroxides are effective in reducing ORI, particularly when added to the fuel and the lubricating oil.

EXAMPLE 3

Using Quaternary Ammonium Hydroxides in a Lubricating Oil Reduces Oil Consumption in Diesel Engines Two oils (Oil 1 and Oil 2) were tested for their oil consumption control capability using a standard Cummins NTC-400 dynamometer test procedure. An inline 6 cylinder turbocharged after-cooled injection diesel engine was used. Both oils were the same fully formulated SAE 30 grade oil, but contained 1.5 wt. % TCMAH from different batches. The results of these tests are shown by the black squares in FIG. 2.

Figure 2:
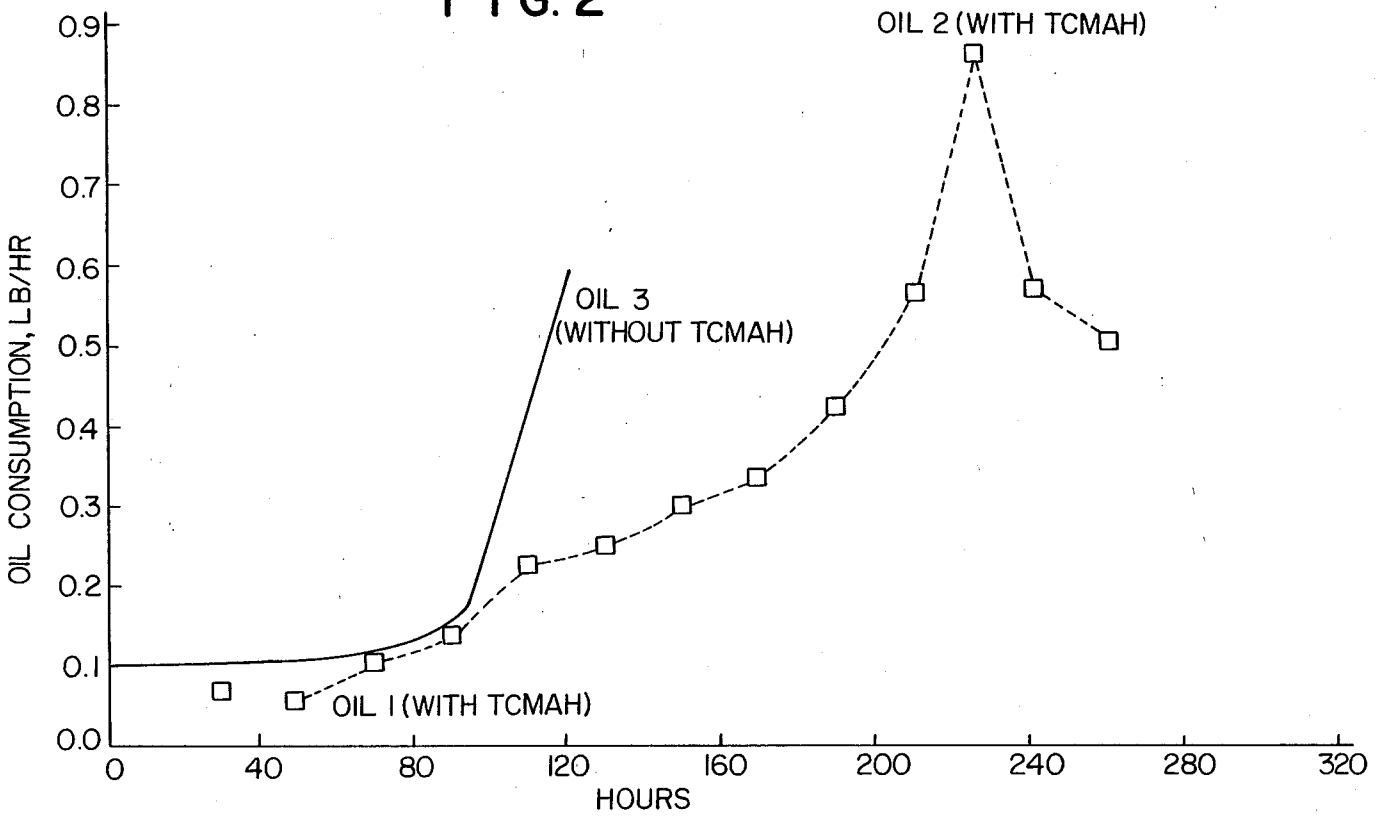
FIG. 2 is a graph showing &:hat oil consumption is reduced when certain quaternary ammonium hydroxides are added to a lubricating oil used in a diesel engine.

The first 40 hours of the test were run with a Cummins SAE 15W40 reference oil without TCMAH (the clear square to ensure the mechanical integrity of the test stand. After 40 hours, the reference oil was drained and the engine flushed and filled with Oil 1, which contained TCMAH. FIG. 2 shows that satisfactory oil consumption control was obtained to about 210 hours, indicating a keep-clean operation with TCMAH. At about 230 hours, when the oil consumption increased to 0.86 lb/hr, Oil 1 was drained and the engine filled (no flushing) with Oil 2, which also contained TCMAH. A continuous drop in oil consumption to 0.5 lb/hr (~41% reduction) occurred at about 260 hours. This indicated that TCMAH may not only extend the duration of satisfactory oil consumption, but may also help the oil clean-up existing engine deposits, resulting in reduced oil consumption.

Six NTC-400 tests were also performed using essentially the same fully formulated SAE 30 oil but without TCMAH (Oil 3). An average of the data from the six tests is also shown in FIG. 2. These data show that oil consumption control was obtained for only about 110 hours without TCMAH compared to 210 hours with TCMAH.

What is claimed is:

1. An improved engine lubricating oil composition comprising a mixture of a major amount of a lubricating base oil and a minor amount of a quaternary ammonium hydroxide having the general formula:

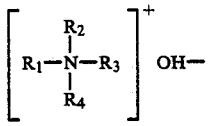

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms.

2. The composition of claim 1 wherein $R_2$ has from 4 to 24 carbon atoms.

3. The composition of claim 1 wherein the quaternary ammonium hydroxide is present in an amount ranging from about 0.1 to about 5 wt. %.

4. The composition of claim 1 wherein Rl, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

5. The composition of claim 4 wherein $R_1$, $R_2$, $R_3$, $R_4$, or mixtures thereof is selected from the group consisting of octyl, dodecyl, decyl, octadecyl, capryl radicals, and mixtures thereof.

6. The composition of claim 5 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

7. The composition of claim 6 wherein the quaternary ammonium hydroxide comprises tricaprylmethyl ammonium hydroxide.

8. The composition of claim 1 wherein $R_1$, $R_2$, $R_3$, $R_4$, or mixtures thereof also contains a nitrogen atom, an oxygen atom, a sulfur atom, or mixtures thereof.

9. An improved automotive lubricating engine oil composition comprising a mixture of a major amount of a lubricating base oil and a minor amount of a quaternary ammonium hydroxide having the general formula:

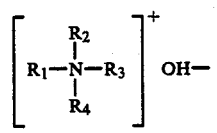

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, the quaternary ammonium hydroxide being present in an amount sufficient to control the octane requirement increase of an engine using said composition.

10. The composition of claim 9 wherein $R_2$ has from 4 to 24 carbon atoms.

11. The composition of claim 9 wherein the quaternary ammonium hydroxide is present in an amount ranging from about 0.1 to about 5 wt. %.

12. The composition of claim 11 wherein the quaternary hydroxide is present in an amount ranging from about 0.2 to about 2 wt. %.

13. The composition of claim 9 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

14. The composition of claim 13 wherein $R_1$, $R_2$, $R_3$, $R_4$, or mixtures thereof is selected from the group consisting of octyl, dodecyl, decyl, octadecyl, capryl radicals, and mixtures thereof.

15. The composition of claim 14 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

16. The composition of claim 15 wherein the quaternary ammonium hydroxide comprises tricaprylmethyl ammonium hydroxide.

17. The composition of claim 9 wherein $R_1$, $R_2$, $R_3$, $R_4$, or mixtures thereof also contains a nitrogen atom, an oxygen atom, a sulfur atom, or mixtures thereof.

18. An improved diesel engine lubricating oil composition comprising a mixture of a major amount of a lubricating base oil and a minor amount of a quaternary ammonium hydroxide having the general formula:

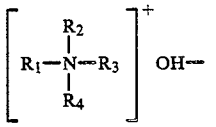

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, the quaternary ammonium hydroxide being present in an amount sufficient to reduce the oil consumption of the diesel engine.

19. The composition of claim 18 wherein $R_2$ has from 4 to 24 carbon atoms.

20. The composition of claim 18 wherein the quaternary ammonium hydroxide is present in an amount ranging from about 0.1 to about 5 wt. %.

21. The composition of claim 18 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

22. The composition of claim 21 wherein $R_1$, $R_2$, $R_3$, $R_4$, or mixtures thereof is selected from the group consisting of octyl, dodecyl, decyl, octadecyl, capryl radicals, and mixtures thereof.

23. The composition of claim 22 wherein the quaternary ammonium hydroxide is selected from the group consisting of dimethyl dioctadecyl quaternary ammonium hydroxide, tetraoctyl ammonium hydroxide, tricaprylmethyl ammonium hydroxide, and mixtures thereof.

24. The composition of claim 23 wherein the quaternary ammonium hydroxide comprises tricaprylmethyl ammonium hydroxide.

25. The composition claim 18 wherein $R_1$, $R_2$, $R_3$, $R_4$, or mixtures thereof contains a nitrogen atom, an oxygen atom, a sulfur atom, or mixtures thereof.

26. A method of controlling the octane requirement increase of a spark ignition internal combustion engine which comprises operating said engine using a lubricating oil containing a major amount of a lubricating base oil and a minor amount of a quaternary ammonium hydroxide having the formula:

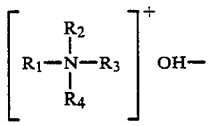

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, the quaternary ammonium hydroxide being present in an amount sufficient to control the octane requirement increase of said engine.

27. The method of claim 26 wherein $R_2$ has from 4 to 24 carbon atoms.

28. The method of claim 26 wherein the quaternary ammonium hydroxide is present in an amount ranging from about 0.1 to about 5 wt. %.

29. The method of claim 28 wherein the quaternary ammonium hydroxide is present in an amount ranging from 0.2 to about 2 wt. %.

30. The method of claim 26 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

31. The method of claim 30 wherein $R_1$, $R_2$, $R_3$, $R_4$, or mixtures thereof is selected from the group consisting of octyl, dodecyl, decyl, octadecyl, capryl radicals, and mixtures thereof.

32. The method of claim 31 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

33. The method of claim 32 wherein the quaternary ammonium hydroxide comprises tricaprylmethyl ammonium hydroxide.

34. The method of claim 26 wherein $R_1$, $R_2$, $R_3$, $R_4$, or mixtures thereof also contains a nitrogen atom, an oxygen atom, a sulfur atom, or mixtures thereof.

35. A method of reducing the oil consumption in a diesel engine which comprises operating said engine using a lubricating oil containing a major amount of a lubricating base oil and a minor amount of a quaternary ammonium hydroxide having the formula:

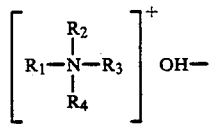

wherein $R_1$ is a hydrocarbon radical or a hydroxy terminated radical having from 1 to 24 carbon atoms, $R_2$ is a hydrocarbon radical having from 1 to 24 carbon atoms, and $R_3$ and $R_4$ are hydrocarbon radicals having from 4 to 24 carbon atoms, the quaternary ammonium hydroxide being present in an amount sufficient to reduce the oil consumption in the engine.

36. The method of claim 35 wherein $R_2$ has from 4 to 24 carbon atoms.

37. The method of claim 35 wherein the quaternary ammonium hydroxide is present in an amount ranging from about 0.1 to about 5 wt. %.

38. The method f claim 35 wherein $R_1$, $R_2$, $R_3$, $R_4$, or mixtures thereof is a normal, branched or substituted alkyl group, unsaturated paraffin group, cyclic hydrocarbon group, aryl group, arylalkyl group, or mixtures thereof.

39. The method of claim 38 wherein $R_1$, $R_2$, $R_3$, $R_4$, or mixtures thereof is selected from the group consisting of octyl, dodecyl, decyl, octadecyl, capryl radicals, and mixtures thereof.

40. The method of claim 39 wherein the quaternary ammonium hydroxide is selected from the group consisting of dimethyl dioctadecyl ammonium hydroxide, tetraoctyl ammonium hydroxide, tricaprylmethyl ammonium hydroxide, and mixtures thereof.

41. The method of claim 40 wherein the quaternary ammonium hydroxide comprises tricaprylmethyl ammonium hydroxide.

42. The method of claim 35 wherein $R_1$, $R_2$, $R_3$, $R_4$, or mixtures thereof also contains a nitrogen atom, an oxygen atom, a sulfur atom, or mixtures thereof.

* * * * *